US005899799A

United States Patent [19]

Tjaden et al.

[11] Patent Number: 5,899,799

[45] Date of Patent: May 4, 1999

[54] METHOD AND SYSTEM TO INCREASE DELIVERY OF SLURRY TO THE SURFACE OF LARGE SUBSTRATES DURING POLISHING OPERATIONS

[75] Inventors: Kevin Tjaden; G. Hugo Urbina, both of Boise, Id.

[73] Assignee: Micron Display Technology, Inc., Boise, Id.

[21] Appl. No.: 08/588,734

[22] Filed: Jan. 19, 1996

[51] Int. Cl.[6] ..... B24B 29/02

[52] U.S. Cl. ..... 451/287; 451/41; 15/102; 15/230

[58] Field of Search ..... 15/97.1, 102, 230, 15/385; 451/41, 66, 285, 287, 288, 289, 290

[56] References Cited

U.S. PATENT DOCUMENTS

| | | |
|---|---|---|
| 3,128,580 | 4/1964 | Davis . |
| 3,795,932 | 3/1974 | Young . |
| 4,728,552 | 3/1988 | Jensen, Jr. . |
| 4,811,443 | 3/1989 | Nishizawa . |
| 4,841,680 | 6/1989 | Hoffstein et al. . |
| 4,927,432 | 5/1990 | Budinger et al. . |
| 4,959,113 | 9/1990 | Roberts . |
| 5,177,908 | 1/1993 | Tuttle . |
| 5,210,472 | 5/1993 | Casper . |
| 5,216,843 | 6/1993 | Breivogel et al. . |
| 5,257,478 | 11/1993 | Hyde et al. . |
| 5,264,010 | 11/1993 | Brancaleoni et al. . |
| 5,382,272 | 1/1995 | Cook et al. . |
| 5,389,352 | 2/1995 | Wang . |
| 5,391,258 | 2/1995 | Brancaleoni et al. . |
| 5,450,647 | 9/1995 | Dorsey . |

FOREIGN PATENT DOCUMENTS

| | | | |
|---|---|---|---|
| 356076382 | 6/1981 | Japan | 451/66 |
| 567382 | 6/1981 | Japan . | |
| 0386467 | 4/1991 | Japan . | |
| 403086467 | 4/1991 | Japan | 451/288 |

*Primary Examiner*—Terrence Till
*Attorney, Agent, or Firm*—Hale and Dorr LLP

[57] ABSTRACT

Grooves are cut into an under pad of a polishing pad assembly formed by an under pad and an over pad. The grooves cause channeling of the over pad so that slurry received on the polishing face of the pad assembly is delivered across the pad assembly's surface in a controlled fashion.

22 Claims, 2 Drawing Sheets

FIG. 1
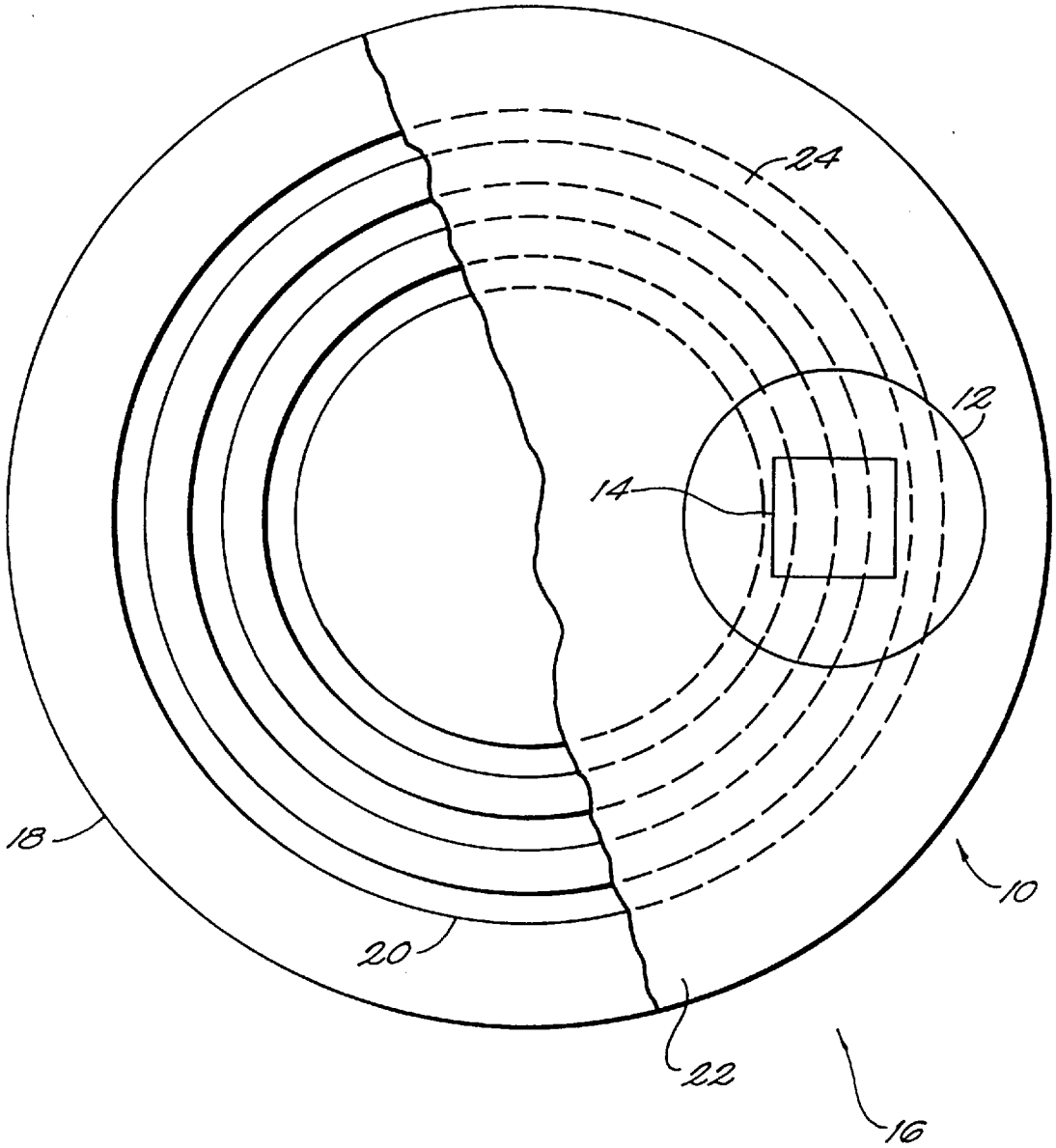
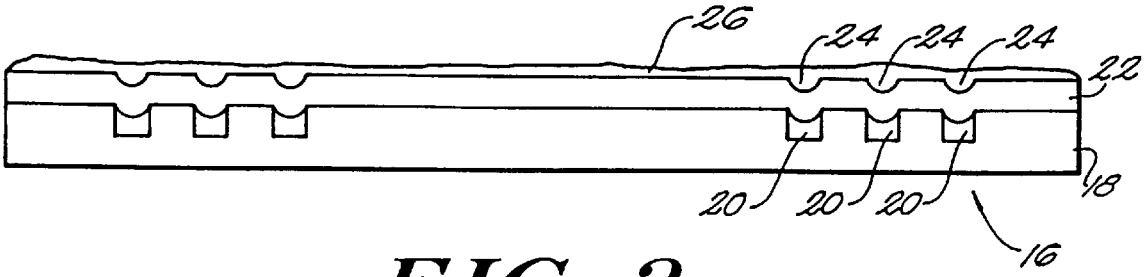
FIG. 2

METHOD AND SYSTEM TO INCREASE DELIVERY OF SLURRY TO THE SURFACE OF LARGE SUBSTRATES DURING POLISHING OPERATIONS

GOVERNMENT RIGHTS

This invention was made with Government support under Contract No. DABT63-93C-0025 awarded by the Advanced Research Projects Agency (ARPA). The Government has certain rights in this invention.

BACKGROUND OF THE INVENTION

The present invention pertains to a method and system for improving delivery of a slurry across a face of a multilayered polishing pad and, more particularly, to polishing large scale assemblies, for example, those used in the manufacture of large area field emission display devices.

Field emission display (FED) technology, as represented for example by U. S. Pat. No. 5,210,472, the disclosure of which is incorporated herein by reference, utilizes a matrix addressable array of pointed, thin film, cold field emission cathodes in combination with a phosphor luminescent screen. The FED incorporates a column signal to activate a column switching driver and a row signal to activate a row switching driver. At the intersection of both an activated column and an activated row, a grid-to-emitter voltage differential exists sufficient to induce a field emission, thereby causing illumination of the associated phosphor of a pixel on the phosphorescent screen. Extensive research has recently been made into the manufacture of an inexpensive, low power, high resolution, high contrast, full color FED.

However, the known FEDs have several structural shortcomings; first and foremost has been their size. It has been possible to produce FEDs of rather small area, but it has theretofore been difficult to produce an FED of sufficient area, for example for the display of a laptop computer or a hand held portable television set. One of the problems in making larger FEDs is producing a uniform surface on the substrate. The present invention addresses this problem.

Fibrous polishing pads per se are well known. For example, U.S. Pat. Nos. 4,728,552; 4,841,680; 4,927,432; and 4,728,552, each disclosure of which is incorporated herein by reference, all describe poromeric pads made from microporous materials. Likewise polishing slurries are known; see for example U.S. Pat. Nos. 4,959,113; 5,264,010; 5,382,272; 5,389,352; and 5,391,258, the disclosures of which are also incorporated herein by reference. A suitable apparatus for planarization of large area substrates for use in field emission displays, and which would benefit from the present invention, is described in U.S. Pat. No. 5,257,478, the disclosure of which is also incorporated herein by reference.

Microchannelling in polishing is a problem that can cause the leading edge of substrates to bind and break. This is true with substrates which have more than one leading edge transition. It becomes even more important when the area to be polished increases and the tolerances decrease. For example, in large area field emission displays, it is important that the substrates be microscopically flat, which means that the surface will have undulations in the range of between about 0.1 and about 4.0 microns from a median plane of the surface. Conventional slurry delivery is concentrated on the edges of a pad without much concern for uniform delivery of the slurry across the face of the surface to be polished. Slurry delivery to the center of larger substrates, of the type contemplated for use in large area field emission display devices, is necessary to accomplish uniform polishing and finish. Thus, there is a need for a method and device to provide for improved polishing and controlled delivery of slurry. It is an object of the present invention to address these needs.

SUMMARY OF THE INVENTION

The present invention concerns improving the delivery of slurry across the face of a polishing pad assembly in a controlled manner by cutting a patterned array of grooves in the underlying pad of the pad assembly. The grooves are so configured to assure channels will form in the polishing pad controlling delivery of a slurry to all parts of the pad.

BRIEF DESCRIPTION OF THE DRAWINGS

The present invention will now be described, by way of example, with reference to the accompanying drawings in which:

FIG. 1 is a plan view of a polishing apparatus incorporating the present invention, with portions of the polishing pad being broken away; and FIG. 2 is a cross-sectional view of a polishing pad assembly incorporating the present invention.

DETAILED DESCRIPTION OF AN ILLUSTRATIVE EMBODIMENT

Figure 3:
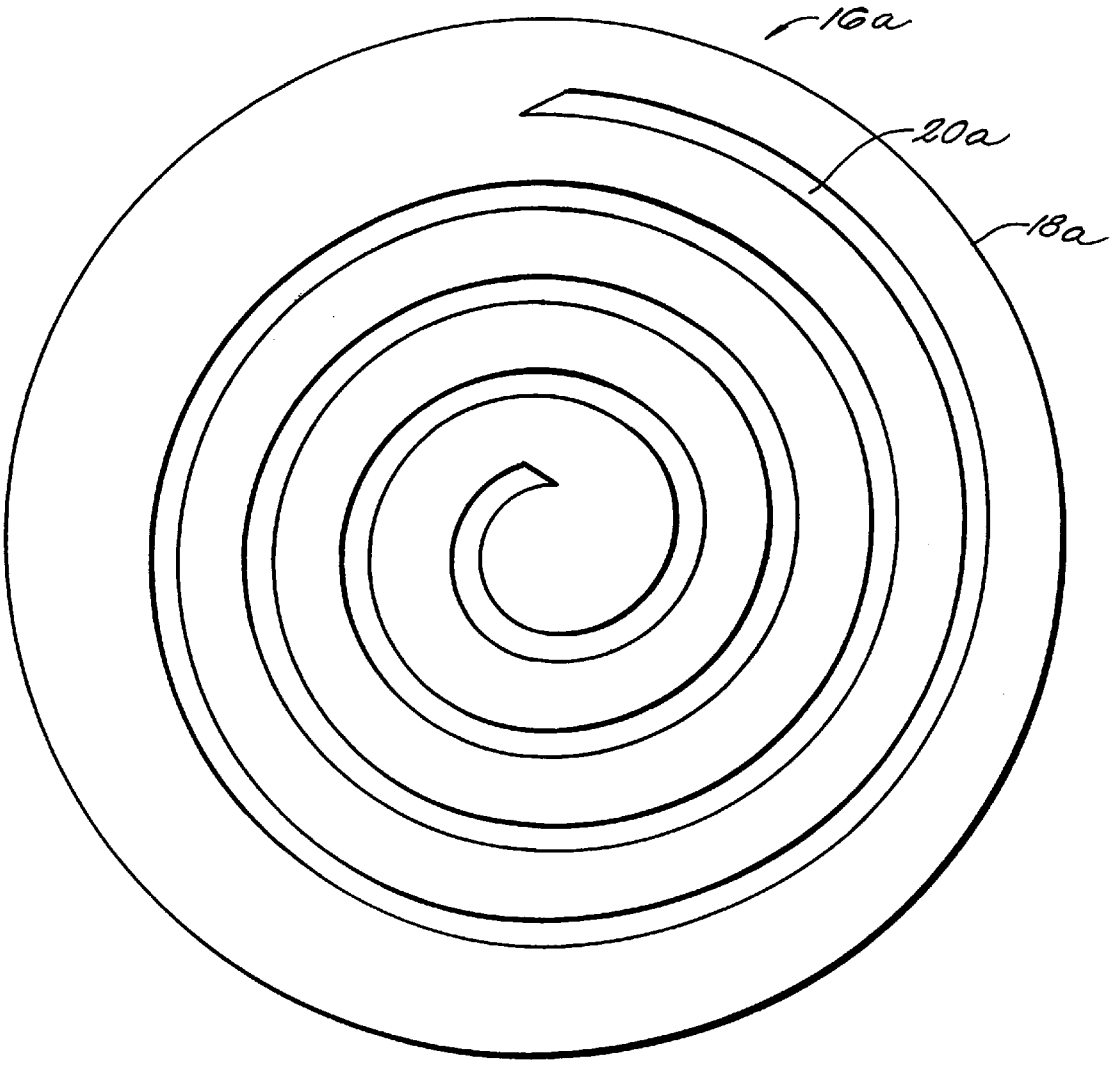
FIG. 3 is a plan view of a pad assembly with a spiral groove.

The present invention precisely controls the amount of slurry delivered to any area of a substrate by proper selection of the size and design of grooves cut into the mating face of the under pad. This gives the ability to control uniformity of slurry distribution, increase the polishing rate and potentially reduce the necessary table dimensions and therefore machine size. Since the transition at the polishing surface is graded, leading edges are not as likely to snag resulting in less breakage and scratching.

Referring to FIG. 1, the polishing machine is generally indicated as 10 and only those portions necessary to the understanding of the present invention have been shown. A head or chuck 12 fixes a substrate 14 with respect to a rotatable pad assembly 16. The pad assembly 16 comprises an under pad 18 and an over pad 22. The under pad is formed from a rigid material and has a patterned array of slots or grooves 20 in the mating face thereof. The over pad 22 is preferably formed from a flexible porous material of the type described in the above mentioned patents.

Turning now to FIG. 2, the under pad 16 has been shown with a series of grooves or slots formed into concentric rings in its mating face. This configuration of the grooves has been shown only to simplify the drawings and should in no way be considered as limiting the scope of the invention. For example, a single spiral groove could be used and/or the groove could have a varying cross section changing the width, depth and even the shape of the groove. The groove 20 underlying the over pad 22 will effectively change the density of the pad assembly allowing the over pad to sink into the groove thereby creating one or more channels 24 for the slurry 26. By controlling the dimension, shape and location of the grooves in the under pad, the flow of the slurry across the face of the pad assembly will be controlled. Thus the present invention can be used to assure adequate delivery of slurry to all portions of the substrate being polished.

Acceptable materials for the under pad include SUBA IV from Rodel, or other commercially available under pads. Acceptable materials for the over pad include IC-60 and IC-1000 from Rodel. The pad assembly can be made with diameters in the range of 6" to 72". The grooves in the under pad can be in substantially any geometric pattern, for example, a spiral, a series of concentric rings, a plurality of concentric arcs, a patterned array of overlapping arcs, pyramids, interleaved pyramids, and gratings. The grooves can have a width in the range of 0.1 mm to 10 mm and have a cross sectional shape which is square, arcuate, trapazoidal, and semicircular. The groove cross section can vary dimensionally across the face of the under pad as well as vary in geometric profile in order to obtain the desired control of distribution of the slurry. The pad assembly is used with any known slurry including Rodel SC-1.

As noted above, a groove can be in a spiral. FIG. 3 is a plan view that shows a spiral groove 20*a* in an under pad 18*a*. Also as noted above, the groove could have a varying cross section changing in width. As shown in FIG. 5, the width of the spiral groove 20*a* is not constant and instead varies along the length of the spiral.

Figure 4:
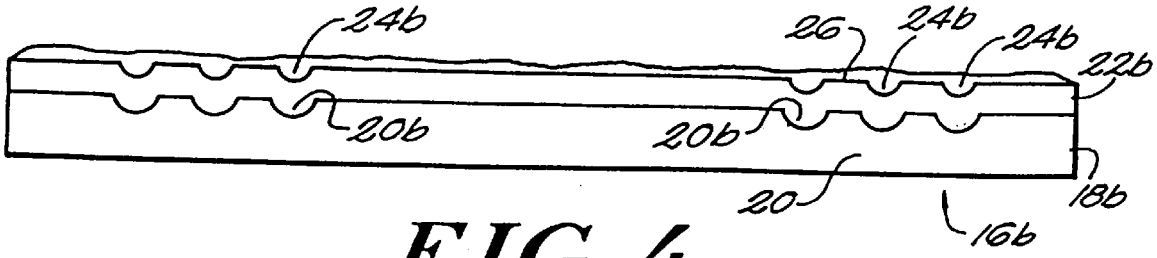
FIG. 4 is a cross section of a polishing pad with grooves that have a semicircular cross section.

As noted above, the grooves can have a cross-sectional shape which is square, arcuate, trapezoidal, and semicircular. FIG. 4 illustrates an embodiment where the grooves 20*b* in under pad 18*b* have a semi-circular cross section. Changing the shape of the groove 20*b* affects the channel 24*b* in top pad 22*b*.

The present invention may be subject to many modifications and changes without departing from the spirit or essential characteristics thereof. The present embodiment should therefor be considered in all respects as being illustrative and not restrictive of the scope of the invention as defmed by the appended claims.

We claim:

1. An improved polishing pad assembly for use in polishing large surface areas of substrates, comprising:

a pad assembly having an under pad and a top pad secured thereto, the top pad having a polishing face, said under pad having at least one groove formed in a surface thereof adjacent the top pad, the groove in the under pad allowing the top pad to sink into the groove, whereby slurry received on the polishing face will be distributed across the face during polishing operations in controlled fashion by said grooves.

2. The improved polishing pad assembly according to claim 1 wherein the top pad is formed from porous material.

3. The improved polishing pad assembly according to claim 1 wherein a plurality of grooves are formed in a regular geometric pattern.

4. The improved polishing pad assembly according to claim 1 wherein one groove is formed in a spiral.

5. The improved polishing pad assembly according to claim 1, wherein a plurality of grooves is formed in concentric rings.

6. A method for forming a polishing pad, the method comprising the steps of:

forming at least one groove in a surface of an under pad;

securing said under pad and an over pad together such that the surface of the under pad faces the over pad, the groove in the under pad allowing the over pad to sink into the groove, whereby slurry received on a polishing face of the over pad will form channels in the polishing face for distributing the slurry across the polishing face of the pad assembly during polishing operations in a controlled fashion.

7. The method according to claim 6 wherein a plurality of grooves are formed in a regular geometric pattern.

8. The method according to claim 6 wherein at least one groove is formed in a spiral.

9. The method according to claim 6 wherein the forming step includes forming a plurality of grooves in concentric rings.

10. A polishing pad assembly, for use in polishing large surface areas of substrates, for use in large area field emission displays, said pad assembly having an under pad and a top pad secured thereto, the improvement comprising a plurality of grooves in a surface of said under pad, the surface being adjacent the top pad, the grooves in the under pad allowing the over pad to sink into the grooves, whereby slurry received on the polishing face will form channels in said upper pad and will be distributed in controlled fashion across the polishing face of the pad assembly, during polishing operations by said grooves.

11. The polishing pad assembly according to claim 10 wherein the top pad is formed porous material.

12. The polishing pad assembly according to claim 10 wherein said under pad is formed of a rigid material.

13. The polishing pad assembly according to claim 10 wherein said grooves are formed in a regular geometric pattern.

14. The polishing pad assembly according to claim 10 wherein said grooves are formed in a spiral.

15. The polishing pad assembly according to claim 10 wherein said grooves vary dimensionally across the under pad to thereby control the channeling of the slurry.

16. The improved polishing pad assembly according to claim 10 wherein the plurality of grooves is formed in concentric rings.

17. A polishing pad assembly for polishing a workpiece with a slurry, the pad assembly comprising:

a first pad having a lower face and an upper face;

a second pad covering the first pad and having a lower face that faces the upper face of the first pad and an upper polishing face that faces away from the first pad;

at least one groove formed in the upper face of the first pad, the groove in the first pad changing the density of the pad assembly such that the second pad can sink into the groove in response to receiving a slurry, thereby forming at least one channel for the slurry in the second pad.

18. The pad assembly of claim 17, wherein there are a plurality of grooves formed in the first pad.

19. The pad assembly of claim 17, wherein a plurality of grooves is formed in concentric rings.

20. The pad assembly of claim 17, wherein the groove is formed in the shape of a spiral.

21. An improved polishing pad assembly for use in polishing large surface areas of substrates, comprising:

a pad assembly having an under pad and a top pad secured thereto, the top pad being formed from porous material and having a polishing face, said under pad having at least one groove formed in a surface thereof adjacent the top pad, whereby slurry received on the polishing face will be distributed across the face during polishing operations in controlled fashion by said grooves.

22. An improved polishing pad assembly for use in polishing large surface areas of substrates, comprising:

a pad assembly having an under pad and a top pad secured thereto, the top pad having a polishing face, said under pad having a plurality of grooves formed in concentric rings in a surface thereof adjacent the top pad, whereby slurry received on the polishing face will be distributed across the face during polishing operations in controlled fashion by said grooves.

* * * * *